US006342289B1

(12) United States Patent
Eguchi et al.

(10) Patent No.: US 6,342,289 B1
(45) **Date of Patent: *Jan. 29, 2002**

(54) RECORDING MEDIUM, PROCESS FOR PRODUCTION THEREOF, AND INK-JET RECORDING METHOD EMPLOYING THE MEDIUM

(75) Inventors: Takeo Eguchi, Tokyo; Kyo Miura, Yokohama; Hitoshi Yoshino, Zama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/771,910

(22) Filed: Dec. 23, 1996

Related U.S. Application Data

(62) Division of application No. 08/528,208, filed on Sep. 12, 1995, now abandoned.

(30) Foreign Application Priority Data

Sep. 16, 1994 (JP) ..... 6-221496
Aug. 31, 1995 (JP) ..... 7-223694

(51) Int. Cl.[7] ..... B41M 5/00
(52) U.S. Cl. ..... 428/195; 428/328; 428/329
(58) Field of Search ..... 428/195, 328, 428/329

(56) References Cited

U.S. PATENT DOCUMENTS

| | | | | |
|---|---|---|---|---|
| 4,202,870 A | | 5/1980 | Weber et al. | 423/630 |
| 4,242,271 A | | 12/1980 | Weber et al. | 260/448 |
| 4,474,847 A | | 10/1984 | Schroder et al. | 428/323 |
| 4,879,166 A | | 11/1989 | Misuda et al. | 428/212 |
| 4,946,666 A | | 8/1990 | Brown | 423/625 |
| 5,104,730 A | | 4/1992 | Misuda et al. | 428/304.4 |
| 5,122,814 A | | 6/1992 | Endo et al. | 346/33 R |
| 5,306,680 A | * | 4/1994 | Fukuda | 501/153 |
| 5,463,178 A | * | 10/1995 | Suzuki et al. | 428/195 |

FOREIGN PATENT DOCUMENTS

| | | | |
|---|---|---|---|
| DE | 3024205 A1 | | 1/1982 |
| EP | 0500021 A1 | | 8/1992 |
| EP | 0 634 287 A1 | | 1/1995 |
| JP | 54-59936 | | 5/1979 |
| JP | 56-76246 | | 6/1981 |
| JP | 56-95985 | | 8/1981 |
| JP | 2-276670 | | 11/1990 |
| JP | 01-64499 | * | 12/1990 |
| JP | 4-37576 | | 2/1992 |
| JP | 5-32037 | | 2/1993 |

OTHER PUBLICATIONS

The Journal of the American Chemical Society vol. LXXIII, date Jan.–Mar. 1951, pp. 373–380.
The Journal of the American Chemical Society vol. LX, dated Jan.–Jun. 1938, pp. 309–319.

* cited by examiner

*Primary Examiner*—Pamela R. Schwartz
(74) *Attorney, Agent, or Firm*—Fitzpatrick, Cella, Harper & Scinto

(57) ABSTRACT

In a recording medium having a porous ink-receiving layer containing alumina hydrate of boehmite structure formed on a base material, the alumina hydrate has crystallinity ranging from 15 to 80 and microcrystals of the alumina hydrate are directed to be parallel to a plane direction of the ink-receiving layer at a parallelization degree of not less than 1.5. The recording medium is employed in an ink-jet recording method conducting printing by ejecting ink droplets through an orifice onto the recording medium.

A process for producing the recording medium comprises the steps of: applying a coating liquid containing alumina hydrate of boehmite structure with shearing stress onto a base material; and drying the coated material to obtain a degree of parallelization of a microcrystal of the alumina hydrate with a plane direction of the ink-receiving layer of not less than 1.5.

7 Claims, 2 Drawing Sheets

RECORDING MEDIUM, PROCESS FOR PRODUCTION THEREOF, AND INK-JET RECORDING METHOD EMPLOYING THE MEDIUM

This application is a division of Application Ser. No. 08/528,208 filed Sep. 12, 1995, now abandoned.

BACKGROUND OF THE INVENTION

1. Field of the Invention

The present invention relates to a recording medium suitable for recording with aqueous ink, particularly to a recording medium suitable for ink-jet recording.

2. Related Background Art

Ink jet recording is a method for recording images and letters by ejecting fine droplets of ink onto a recording medium such as a paper a sheet. Ink jet recording is rapidly becoming popular in recent years for various applications because of its high recording speed, ease of multicolor recording, flexibility in pattern recording, and because image fixation is not needed. Multicolor ink-jet recording is coming to be used in full color image recording since it is capable of giving images comparable with images formed by multicolor gravure printing or color photography, and is less expensive than multicolor printing when the number of reproduction is small. With improvements in recording speed, fineness of recording, and full color recording, the recording medium is required to have better qualities in addition to the improvements of the recording apparatus and the recording method.

Hitherto, various types of recording mediums have been disclosed. For example, recording sheets having a layer containing alumina hydrate of pseudo boehmite structure are disclosed in U.S. Pat. Nos. 4,879,166 and 5,104,730, and Japanese Patent Laid-Open Application Nos. 2-276670, 4-37576, and 5-32037. The prior art recording mediums involve disadvantages as follows: occurrence of beading of ink dots, due to insufficient absorbency for a large amount of ink in color image printing; likelihood of being scratched by a sheet delivery device due to insufficient surface hardness; likelihood of the ink-receiving layer surface cracking due to insufficient bonding strength of the ink-receiving layer; low circularity of printed dots cracking due to insufficient uniformity of the ink-receiving layer; and low gloss of recording medium due to less orientation of the pigment.

The beading mentioned in the present invention refers to a phenomenon in which dots irregularly move in the plane direction of the surface of an ink-receiving layer when the ink is still fluid before it is fixed in the ink-receiving layer.

The present invention has been made to offset the above disadvantages.

SUMMARY OF THE INVENTION

An object of the present invention is to provide a recording medium which has high ink absorbency to absorb ink at a higher absorbing rate and having higher surface hardness to be less liable to cracking on the surface.

Another object of the present invention is to provide a recording medium which is capable of forming an image with high circularity of dots and high gloss of the recorded image.

A still another object of the present invention is to provide a recording medium which provides water fastness and light fastness of the recorded image with less migration of the ink, in addition to the aforementioned properties.

A further object of the present invention is to provide a process for producing the aforementioned recording medium.

A still further object of the present invention is to provide an ink-jet recording method employing the aforementioned recording medium.

According to an aspect of the present invention, there is provided a recording medium having a porous ink-receiving layer containing alumina hydrate of boehmite structure formed on a base material, the alumina hydrate having crystallinity ranging from 15 to 80.

According to another aspect of the present invention, there is provided a recording medium having a porous ink-receiving layer containing alumina hydrate of boehmite structure formed on a base material, wherein microcrystals of the alumina hydrate are directed to be parallel to the plane direction of the ink-receiving layer at a parallelization degree of not less than 1.5.

According to still another aspect of the present invention, there is provided a recording medium having a porous ink-receiving layer containing alumina hydrate of boehmite structure formed on a base material, the alumina hydrate having crystallinity ranging from 15 to 80, and the microcrystals of the alumina hydrate being directed to be parallel to the plane direction of the ink-receiving layer at a parallelization degree of not less than 1.5.

According to a further aspect of the present invention, there is provided an ink-jet recording method employing the above recording medium.

According to a still further aspect of the present invention, there is provided a process for producing a recording medium having a porous ink-receiving layer containing alumina hydrate of boehmite structure, comprising the steps of: applying a coating liquid containing alumina hydrate of boehmite structure with shearing stress onto a base material; and drying the coated material to obtain the degree of parallelization of the microcrystal of the alumina hydrate with the plane direction of the ink-receiving layer of not less than 1.5.

According to a still further aspect of the present invention, there is provided a process for producing a recording medium, comprising the steps of: applying a liquid dispersion containing alumina hydrate of boehmite structure having crystallinity ranging from 15 to 80 onto a base material; and drying the coated material at a relative humidity of 20 to 60% to obtain crystallinity of the alumina hydrate ranging from 15 to 80 in the recording medium.

According to a still further aspect of the present invention, there is provided a process for producing a recording medium, comprising the steps of: applying a liquid dispersion containing alumina hydrate of boehmite structure having crystallinity of lower than 15 onto a base material; and drying the coated material at a relative humidity of 10 to 20% to obtain crystallinity of the alumina hydrate ranging from 15 to 80 in the recording medium.

According to a still further aspect of the present invention, there is provided a process for producing a recording medium comprising the steps of: applying a liquid dispersion containing alumina hydrate of boehmite structure having crystallinity of lower than 15 on a base material; and heating the coated material at a relative humidity of 10 to 20% to obtain crystallinity of the alumina hydrate ranging from 15 to 80 in the recording medium.

BRIEF DESCRIPTION OF THE PREFERRED EMBODIMENTS

DESCRIPTION OF PREFERRED EMBODIMENTS

Figure 1:
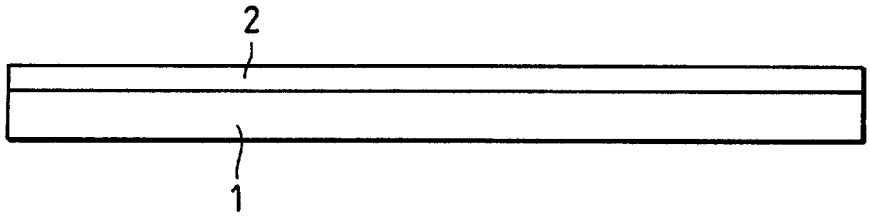
FIG. 1 is a schematic sectional view for explaining a recording medium of the present invention.

The recording medium according to the present invention exhibits high ink absorbency, absorbs ink at a high rate, has sufficient surface hardness, is less liable to cause cracking of the surface, provides high circularity of printed dots, and has high gloss. The recording medium provides good water fastness and good light-fastness to the recorded matter with less migration of the recording liquid.

The recording medium of the present invention, in an embodiment, has one ink-receiving layer 2 of a porous structure comprising alumina hydrate and a binder provided on a base material 1.

The alumina hydrate, which is positively charged, is preferred as the constituting material for the ink-receiving layer, since it fixes the applied ink by a positive charge to give excellent colors to images, and does not involve the disadvantages of browning of black ink and low light-fastness which are problems associated with the use of a silica type compound for the ink-receiving layer. Of the alumina hydrates, one having boehmite structure is more suitable because of high adsorbability of dyes, high absorbency of ink, and high transparency.

The alumina hydrate contained in the recording medium of the present invention is defined by the general formula below:

$$Al_2O_{3-n}(OH)_2.mH_2O$$

where n is an integer of zero to 3, and m is a number of from zero to 10, preferably from zero to 5. In many case, "$mH_2O$" expresses a free water phase which does not contribute to the construction of a crystal lattice and is releasable. Therefore, the value of "m" is not necessarily an integer. The value of "m" may become zero when the alumina is calcined.

The process for producing the alumina hydrate having a boehmite structure to be incorporated into the recording medium of the present invention is not specially limited. The process includes Bayer process, alum pyrolysis process, and other processes for producing alumina hydrate. A suitable process is hydrolysis of a long-chain alkoxide of aluminum by addition of an acid. The long-chain alkoxide herein means alkoxides of 5 or more carbons, more preferably alkoxides of 12 to 22 carbons. With such an aluminum alkoxide, removal of the alcohol component and control of the shape of the alumina hydrate of boehmite structure are facilitated. The above-mentioned processes are advantageous because of less likelihood of contamination by ions and other impurities in comparison with processes using alumina hydrogel or cationic alumina. Further, long-chain alkoxides of aluminum are advantageous in that the alcohol resulting from the hydrolysis can readily be removed completely from the alumina hydrate in comparison with short-chain alkoxides such as aluminum isopropoxide.

The alumina hydrate prepared by the above process may be subjected to hydrothermal synthesis to allow the particles to grow, or may be dried to obtain powdery alumina hydrate.

In the present invention, a liquid dispersion containing the alumina hydrate and a binder is applied onto a base material, and the applied matter is subjected to drying and other treatments to form a recording medium having a porous ink-receiving layer. The properties of the recording medium depend on the alumina hydrate employed, the liquid dispersion, and the conditions of production such as coating application and drying. In the present invention, it was found that the ink absorbency of the porous ink-receiving layer can be improved and the cracking thereof can be prevented by control of the crystallinity and the parallelization degree of the alumina hydrate in the layer.

Figure 2A:
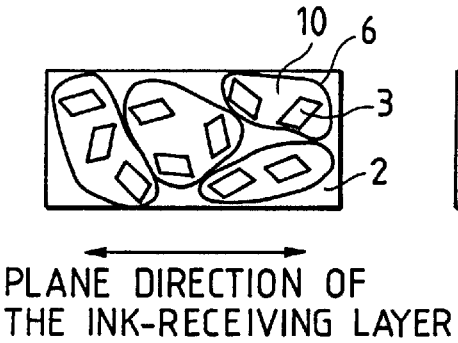
FIGS. 2A to 2D are schematic sectional views for explaining the degree of parallelization of the microcrystals in the recording medium of the present invention.

The crystallinity in the present invention is defined as follows:

As shown in FIG. 2A, particles of alumina hydrate 6 having boehmite structure contained in the ink-receiving layer 2 are constituted of non-crystalline portions 10 and crystalline portions (boehmite microcrystals) 3.

The crystallinity degree means the ratio of crystalline portion to the entire alumina hydrate having a boehmite structure. -The crystallinity is derived from an X-ray diffraction pattern measured by CuKα line of the pulverized ink-receiving layer, from the ratio of the peak intensity of the plane (020) appearing at about $2\theta=14°-15°$ to the peak intensity at $2\theta=10°$. The crystallinity is disclosed in Japanese Patent Laid-Open Application Nos. 56-76246 and 56-95985.

In the present invention, the crystallinity of the alumina hydrate in the ink-receiving layer is preferably in the range of from 15 to 80. Within this range, the ink absorbency and the ink absorbing rate are satisfactory. More preferably, the crystallinity ranges from 20 to 70. Within this range, the surface hardness is higher, and the cracking is less likely to occur. At a crystallinity lower than 15, the ink absorbency and the ink absorbing rate are insufficient, whereas at a crystallinity higher than 80, the affinity to water is lower, which makes beading of ink dots likely to occur.

Figure 2B:
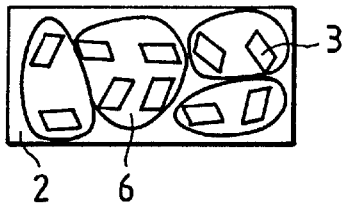
Figure 2C:
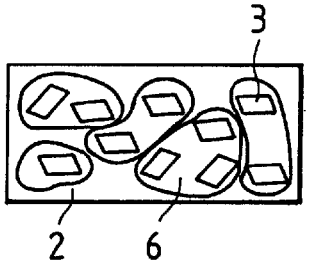
Figure 2D:
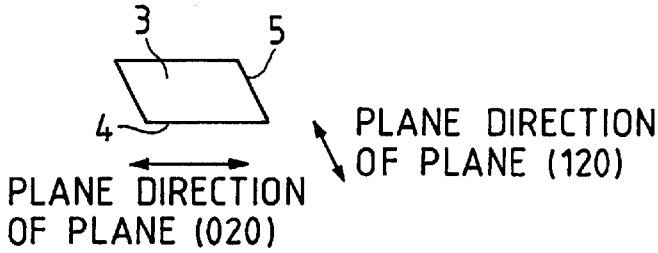

The parallelization degree in the present invention is defined as follows. As shown in FIG. 2A, the parallelization degree relates to the ratio of fine boehmite crystals 3 having (020) planes parallel to the plane direction of the ink-receiving layer to the entire fine boehmite crystals contained in the ink-receiving layer. FIG. 2D shows the plane direction of alumina hydrate fine crystals drawn in FIGS. 2A, 2B and 2C. The alumina hydrate has planes (020) 4 and planes (120) 5 as shown in FIG. 2D.

To measure the parallelization degree, the ratio of the intensities of X-ray diffraction peaks measured by CuKα line of plane (020) to that of plane (120) is derived for the ink-receiving layer (Ratio A); and separately the same ratio is derived for the pulverized ink-receiving layer (Ratio B). The parallelization degree is represented by the ratio of Ratio A to Ratio B.

When the planes (020) are directed completely at random, the parallelization degree of the ink-receiving layer is 1. As shown in FIGS. 2A to 2C, a higher parallelization degree means a higher ratio of the plane (020) parallel to the ink-receiving layer face. The parallelization degrees in FIGS. 2A, 2B and 2C are low, moderate, and high, respectively.

The recording medium of the present invention has a parallelization degree of preferably not less than 1.5 to obtain a higher circularity of the printed dots. If the parallelization degree is less than 1.5, the circularity of the printed dots is low. The parallelization degree is more preferably 2 or higher, thereby making the gloss of the recording medium higher.

Figure 3A:
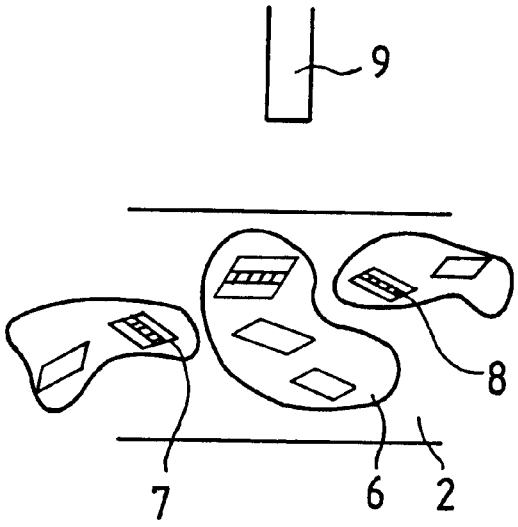
FIGS. 3A and 3B are schematic sectional views for explaining the dependency of ink absorbing rate on the direction of the planes (020) of microcrystalline alumina hydrate in the recording medium of the present invention.
Figure 3B:
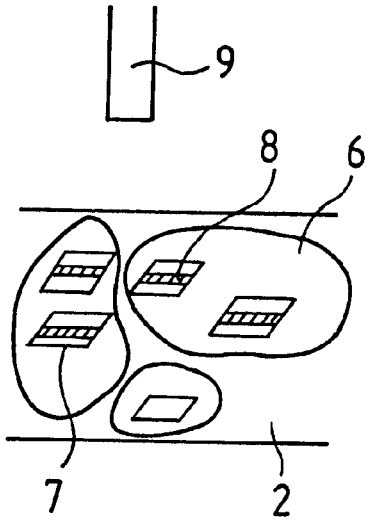

The mechanism of ink absorption in the recording medium of the present invention is assumed to be described as below. The ink droplets deposited on the surface of the recording medium are absorbed mainly by the interspaces between the planes (020) in the alumina hydrate particles. In a recording medium having a low parallelization degree as shown in FIG. 3A, the deposited ink diffuses non-uniformly due to random orientation of the crystal planes (020) in the ink-receiving layer face direction. On the other hand, in a recording medium having a high parallelization degree as shown in FIG. 3B, the ink diffuses uniformly in the recording layer face direction. Thereby, the circularity of the printed dots is presumed to be higher in the recording medium having the parallelization degree of 1.5 or more. In FIGS. 3A and 3B, the numeral 7 indicates a microcrystal of alumina hydrate particle into which ink 8 has penetrated. The numeral 9 indicates a printing head of the printer.

The light refractivity of the alumina hydrate at the crystalline portion differs from that at the non-crystalline portion. Therefore, the recording medium having randomly oriented crystal plane (020) of the alumina hydrate exhibits more noticable light scattering than one having uniformly oriented planes (020). Therefore, a recording medium having a parallelization degree of 2 or higher exhibits lower light scattering and has higher gloss, presumably.

The recording medium, which has crystallinity of the alumina hydrate of from 15 to 80 and a parallelization degree of the alumina hydrate microcrystal of 1.5 or higher, has high water resistance and high light-fastness, and does not cause migration of the dye during storage, desirably. When the crystallinity is outside the above range, the affinity of the recording medium to the ink is lower, which causes migration repulsion, and beading of the ink, and retards the ink absorption. With the parallelization degree outside the above range, migration of the ink is likely to occur, due to the lower bonding strength of the dye to the recording medium. The dye of the ink is adsorbed by the interspaces between the crystal planes (020) of alumina hydrate microcrystals. The adsorbed dye is less releasable in the recording medium having higher parallelization degree due to higher adsorption strength caused by interaction of the uniformly orientated alumina crystal planes (020). This is because the recording medium having a higher parallelization degree has a lot of almina microcrystal planes (020), whereby many adsorbing points are provided therein, and if the recording medium has a higher parallelization degree too, the planes (020) are uniformly oriented. Therefore, the above-mentioned effects can be obtained with the recording medium having the crystallinity and parallelization degree in the aforementioned ranges.

The aforementioned Japanese Patent Laid-Open Application No. 2-276670 describes a recording medium employing an agglomerate of fine alumina particle oriented in one direction which is formed by orienting particles of alumina hydrate, and has a constitution different from the recording medium having a specified parallelization degree of the planes (020) of the present invention. Furthermore, this Japanese Patent Laid-Open Application does not mention the circularity and the gloss which are the effects of the present invention, and is based on the idea different from the present invention.

The crystallinity of the alumina hydrate in the recording medium can be changed by controlling the heating conditions in drying the alumina hydrate-containing dispersion, and the parallelization degree can independently be changed by shearing stress on application of the dispersion.

The crystallinity of the alumina hydrate employed in the present invention is preferably in the range of from 15 to 80, since crystallinity within this range can be attained easily. The alumina hydrate which has a crystallinity of less than 15 can be changed to have higher crystallinity in later processing. The alumina hydrate may be in a needle shape or in a plate shape. The particle size of the alumina hydrate is preferably in the range of from 1 to 50 nm in the maximum length for a needle-shaped particle or in the maximum diameter for a plate-shaped particle, since the viscosity of the dispersion is low and cracking or powder-falling is less likely to occur in this particle size range. The alumina hydrate has preferably a pore volume ranging from 0.1 to 1.0 $cm^3/g$, and a pore radius ranging from 2.0 to 20.0 nm in view of ink absorbency. The specific surface area of the alumina hydrate ranges preferably from 10 to 500 $m^2/g$ in view of the low haze of the ink receiving layer for obtaining a glossy image and for observing an image by transmitted light.

The recording medium of the present invention can be prepared by applying a liquid dispersion containing the alumina hydrate and a binder onto a base material. By controlling the shearing stress in a specified range on application of the liquid dispersion onto the base material, the microcrystal planes (020) can be oriented in the direction parallel to the flow of the coating liquid dispersion, whereby the recording medium is made to have a high parallelization degree. The required shearing stress depends on the coating method and the viscosity of the liquid dispersion, and ranges preferably from 0.1 to 20.0 $N/M^2$. In this range of shearing stress, microcrystals of the alumina hydrate are oriented to have a parallelization degree of 1.5 or more. When the shearing stress is lower than the above range, it is difficult to make the parallelization degree 1.5 or higher. With the shearing stress higher than the above range, the resulting ink-receiving layer tends to be non-uniform in thickness.

The coating may be conducted by any method, provided that the shearing stress in the above range can be applied. The preferred coating method includes kiss-roll coating, extrusion coating, slide hopper coating, curtain coating, blade coating, brush coating, bar coating, and gravure coating.

The suitable coating speed depends on the coating method. With a coating method in which the shearing stress depends on the coating speed, such as kiss-roll coating, extrusion coating, slide hopper coating, curtain coating, and bar coating, the coating speed ranges preferably from 0.01 to 10 m/s. At a coating speed of lower than 0.01 m/s, little shearing stress will be applied, and the parallelization degree tends to be lower. At a coating speed of higher than 10 m/s, the thickness of the ink-receiving layer is not readily controllable uniformly. The viscosity of the liquid dispersion at the time of the coating ranges preferably from 10 to 500 mPa·s. At a viscosity of lower than 10 mPa·s, the shearing stress given to the liquid dispersion is lower, and thereby the parallelization degree of alumina hydrate microcrystals in the resulting recording medium tends to be lower. At a viscosity of higher than 500 mPa·s, the thickness of the ink-receiving layer is not readily controllable uniformly. The amount of the coating of the liquid dispersion ranges preferably from 2 to 60 $g/m^2$ in terms of the dried solid matter.

The liquid dispersion after coating application is dried, preferably without blowing of drying air thereon, at least for one second to be thickened and set in an oriented state of the microcrystal planes (020) of the alumina hydrate by utilizing thixotropy of the liquid dispersion. If drying air is blown on the unset coating layer, it displaces the particles of the alumina hydrate and destroys the oriented state of the crystal planes (020) of the alumina hydrate which were made by the shearing stress, resulting in a low parallelization degree.

The applied coating liquid dispersion containing the alumina hydrate forms the ink-receiving layer by heat-drying.

It was found that the crystallinity can be controlled to be within the above specified range by controlling the heating rate, drying temperature, and drying time. Particularly, the crystallinity depends on the drying speed.

Therefore, the crystallinity can be controlled within the above range by controlling the humidity, temperature and drying time in the process of drying the liquid dispersion. When the recording medium is prepared from alumina hydrate having a crystallization degree of from 15 to 80 dispersed in a coating liquid dispersion, drying at a relative humidity ranging from 20% to 60% gives the alumina hydrate in the resulting recording medium a crystallinity in the above specified range. Drying at a relative humidity lower than 20% makes it difficult to control the crystallinity of the recording medium because of the large change in the crystallinity of the alumina hydrate per unit time. Drying at a relative humidity higher than 60% tends to cause non-uniform thickness of the ink-receiving layer because of the lower drying speed of the coating film.

When the recording medium is prepared from alumina hydrate having a crystallization degree of lower than 15 dispersed in a coating liquid dispersion, drying at a relative humidity ranging from 10% to 20% gives the crystallinity of the alumina hydrate in the resulting recording medium in the above specified range. Further, an alternative process can be provided, which comprises applying onto a base material a liquid dispersion containing alumina hydrate having crystallinity of lower than 15, followed by drying the liquid dispersion to form an ink receiving layer, and heating the obtained recording medium at a relative humidity of 10 to 20%, whereby it is possible to control the crystallinity within the above-mentioned range. Drying at a relative humidity lower than 10% makes it difficult to control the crystallinity to be not higher than 80 because of the rapid rise in the crystallinity of the alumina hydrate per unit time. In this case, it is also likely to generate cracking. Drying at a relative humidity of higher than 20% does not result in the intended crystallinity because of lack of increase in the crystallinity.

The most suitable heat-drying conditions (temperature and time) depend on the composition of the coating liquid, but are generally a heating temperature ranging from 60° C. to 150° C., and a heating time ranging from 2 seconds to 30 minutes. It is difficult to achieve the crystallinity in the above specified range at a drying temperature of lower than 60° C. even at the aforementioned humidity range. At a drying temperature higher than 150° C., the crystallinity will exceed the above specified range due to excessively high drying speed, and furthermore the ink-receiving layer is likely to be cracked. At a drying time of less than 2 seconds, the formed ink-receiving layer will become non-uniform in layer thickness because of insufficient drying time. A drying time of longer than 30 minutes is not effective since the change of the crystallinity will be finished within 30 minutes.

The above heating process can be conducted with a drying apparatus including hot air driers such as a direct tunnel drier, an arch drier, an air loop drier, and a sine-curve air float drier; infrared heating driers; microwave driers; and heating rolls.

The binder which may be used with the alumina hydrate in the present invention may be selected from water-soluble polymers, including preferably polyvinyl alcohol and modifications thereof (cation-modified, anion-modified, and silanol-modified), starch and modifications thereof (oxidized, and etherified), gelatin and modifications thereof, casein and modifications thereof, gum arabic, cellulose derivatives such as carboxymethylcellulose, hydroxyethylcellulose, and hydroxypropylmethyl-cellulose, SBR latexes, NBR latexes, diene type copolymer latex such as methyl methacrylate-butadiene copolymer latex, functional group-modified polymer latexes, vinyl copolymer latexes such as ethylene-vinyl acetate copolymer latex, polyvinylpyrrolidones, maleic anhydride copolymers, acrylic ester copolymers, and the like.

The mixing weight ratio of the alumina hydrate having boehmite structure to the binder ranges preferably from 5:1 to 25:1. Within this range, the cracking or the powder-falling of the ink-receiving layer can be prevented. The mixing weight ratio ranges more preferably from 5:1 to 20:1. Within this range, cracking can be prevented which is caused by folding of the recording medium.

To the pigment and the binder, there may be added a pigment dispersant, a viscosity increaser, a pH controller, a lubricator, a fluidity modifier, a surfactant, an antifoaming agent, water-proofing agent, a foam inhibitor, a releasing agent, a foaming agent, a penetrating agent, a coloring dye, a fluorescent whitener, an ultraviolet absorber, an antioxidant, an antiseptic agent, a mildewproofing agent, and the like. The water-proofing agent may be selected from known materials such as quaternary ammonium salts, and polymeric quaternary ammonium salts.

The base material may be a paper sheet such as a sized paper sheet, a non-sized paper sheet, or a resin-coated paper; a sheet-shaped material such as a thermoplastic resin film; or cloth. The thermoplastic resin film may be a transparent film of a resin such as polyester, polystyrene, polyvinyl chloride, polymethyl methacrylate, cellulose acetate, polyethylene, or polycarbonate; or a pigment-filled or finely-foamed opaque plastic sheet.

The ink-receiving layer constituting the recording medium of the present invention has a total pore volume ranging preferably from 0.1 to 1.0 $cm^3/g$. With the pore volume larger than a above range, the ink-receiving layer is likely to cause cracking or powder-falling therefrom. With the pore volume smaller than the above range, the ink-receiving layer exhibits low ink-absorbency, and is likely to cause migration of ink on the ink-receiving layer particularly in multicolor printing.

The ink-receiving layer has a BET specific surface area preferably ranging from 20 to 450 $m^2/g$. With a specific surface area smaller than this range, the ink-receiving layer is not glossy, and has a high haze which gives a hazed image. With a specific surface area larger than the above range, the ink-receiving layer is likely to crack. The aforementioned BET specific surface area and the pore volume are measured, after degassing treatment at 120° C. for 24 hours, by a nitrogen adsorption-desorption method.

The ink employed in the recording according to the present invention comprises a coloring material (dye or pigment), a water-soluble organic solvent, and water as the main constituents. The dye is preferably a water-soluble dye such a direct dye, acid dye, basic dye, reactive dye, or food dye. Any dye may be used, provided that it has the required properties such as fixability, color-developability, sharp image formation, stability, and light-fastness in combination with the recording medium.

The water-soluble dye is generally used as a solution in water or a mixed solvent of water and an organic solvent. The solvent is preferably a mixture of water and a water-soluble organic solvent. The water content in the ink ranges preferably from 20% to 90%, more preferably from 60% to 90% by weight.

The aforementioned water soluble organic solvent includes alkyl alcohols of 1 to 4 carbons such as methyl alcohol, ethyl alcohol, n-propyl alcohol, isopropyl alcohol, n-butyl alcohol, s-butyl alcohol, t-butyl alcohol, and isobutyl alcohol; amides such as dimethylformamide, and dimethylacetamide; ketones and ketone alcohols such as acetone, and diacetone alcohol; ethers such as tetrahydrofuran, and dioxane; polyalkylene glycols such as polyethylene glycol, and polypropylene glycol; alkylene glycols having an alkylene group of 2 to 6 carbons such as ethylene glycol, propylene glycol, 1,2,6-hexanetriol, thiodiglycol, hexylene glycol, and diethylene glycol; glycerol; lower alkyl ethers of polyhydric alcohols such as ethylene glycol methyl ether, diethylene glycol monomethyl ether, diethylene glycol ethyl ether, triethylene glycol monomethyl ether, and triethylene glycol monoethyl ether; and the like.

Of these water-soluble organic solvents, polyhydric alcohols such as diethylene glycol, and lower alkyl ethers of polyhydric alcohols such as triethylene glycol monomethyl ether, and triethylene glycol monoethyl ether are preferred. The polyhydric alcohols are advantageous since they serves as a lubricant for preventing the clogging of nozzles caused by deposition of the water-soluble dye resulting from evaporation of water from the ink.

The ink may contain a solubilizing agent, typically a nitrogen-containing heterocyclic ketone, for increasing remarkably the solubility of the water-soluble dye in the solvent. The examples of the effective solubilizing agent are N-methyl-2-pyrrolidone, and 1,3-dimethyl-2-imidazolidinone. For further improvement of the properties, there may be added an additive such as a viscosity improver, a surfactant, a surface tension controller, a pH controller, a specific resistance improver, and the like.

On the recording medium, recording is conducted with the above ink preferably by ink-jet recording. Any ink-jet recording method is applicable which ejects ink through a nozzle to deposit the ink on the recording medium. In particular, the method disclosed in Japanese Patent Laid-Open Application No. 54-59936 is effective. In this method, thermal energy is applied to the ink to cause an abrupt volume change of the ink to eject the ink through the nozzle by the action of the volume change.

The present invention is described in more detail by reference to Examples and Comparative Examples. The properties of the present invention were measured by the procedures below.

[Crystallinity and Parallelization Degree]

The ink-receiving layer was separated from the recording medium, pulverized, and subjected to X-ray diffraction measurement. The diffraction intensity was measured at 2θ=10°, and the diffraction peak intensities were measured for the plane (020) and the plane (120), from the X-ray diffraction pattern. Independently, the diffraction peak intensities of the separated ink-receiving layer, not pulverized, were measured similarly for the plane (020) and the plane (120) from the X-ray diffraction pattern. The crystallinity and the parallelization degree were derived according to the equations below.

$$\text{Crystallinity} = \frac{\text{Peak intensity for plane (020)}}{\text{intensity at } 2\theta = 10^\circ}$$

$$\text{Intensity ratio for powder} = \frac{\text{Peak intensity for plane (020) of powder}}{\text{Peak intensity for plane (120) of powder}}$$

-continued $$\text{Intensity ratio for medium} = \frac{\text{Peak intensity for plane (020) of medium}}{\text{Peak intensity for plane (120) of medium}}$$

(Ink-receiving layer)

$$\text{Parallelization degree} = \frac{\text{Intensity ratio for medium}}{\text{Intensity ratio for powder}}$$

The conditions for the above X-ray diffraction measurement were as below:

| | |
|---|---|
| Apparatus: | RAD-2R (Rigaku Denki K.K.) |
| Target: | CuKα |
| Optical system: | Wide angle goniometer (with curved graphite monochrometer) |
| Gonio radius: | 185 mm |
| Slits: | DS 1°, RS 1°, SS 0.15 mm |
| X-ray output: | 40 kV, 30 mA |
| Measurement: | Method of 2θ − θ<br>Continuous scanning, every 0.02° for 2θ<br>2θ = 10° to 90°, 2°/min |

[BET Specific Surface Area, and Pore Volume]

The specific surface area and the pore volume were measured, after sufficient heating and degassing treatment of the recording medium, by the nitrogen adsorption-desorption method.

Measurement Apparatus: Autosorb 1 (Quanta Chrome Co.)

The BET specific surface area was calculated according to the method of Brunauer, et al. (J. Am. Chem. Soc., Vol.60, p.309, (1938)).

The pore volume was calculated according to the method of Barrett, et al. (J. Am. Chem. Soc., Vol.73, p.373 (1951)).

[Ink Absorbency]

Ink-jet recording was conducted by an ink-jet printer provided with an ink-jet head having 128 nozzles for four colors of Y, M, C, and Bk with the nozzle spacing of 16 nozzles per mm by use of the inks having the compositions shown below. The ink absorbency was evaluated by solid-printing singly with a Bk color ink and immediately thereafter testing the ink drying state at the surface of the ink-receiving layer by finger touch. The usual amount of ink for single color printing was prescribed to be 100%. The ink absorbency of the recording medium was evaluated to be "good" when the ink did not transfer to the finger with the amount of the ink of 200%; to be "fair" when the ink did not transfer to the finger with the amount of 100%; and to be "poor" when the ink transferred to the finger with the amount of 100%.

| Ink Composition: | |
|---|---|
| C.I. Food Black 2 | 5 parts |
| Diethylene glycol | 15 parts |
| Polyethylene glycol | 20 parts |
| Water | 70 parts |

[Ink Absorption Rate]

Bk single color solid printing was conducted with the same ink-jet printer and the same ink as the ones used in the above ink absorbency test with an amount of ink of 200%. The drying state was tested by finger touch on the printed area, and the time elapsed before the ink became non-transferable to the touching finger was measured.

[Surface Hardness]

The surface hardness was tested according to the pencil scratch test for paint film of JIS K5401-1969.

[Cracking]

Occurrence of cracking at the surface of the recording medium was examined visually. The recording medium was evaluated to be "good" when no cracking was observed; to be "fair" when cracking was observed locally; and to be "poor" when cracking occurs over the entire surface.

[Circularity]

Bk printing was conducted dot by dot by using the same ink jet printer and the same ink as the ones used in the above ink absorbency test. The major diameter D and the minor diameter d of one dot was measured by microscopy. The ratio of d/D was taken as the measure of the circularity.

[Gloss]

The gloss of the recording medium at the non-printed area was measured by a gloss meter (Gloss Checker-IG-320, Horiba Seisakusho K.K.).

[Water Fastness]

Single color solid-printing was conducted by using the same ink jet printer and the same ink as the ones used in the above ink absorbency test. The printed recording medium was immersed in flowing water for 3 minutes, and was air-dried. The water-resistance was represented by the equation below.

$$\text{Water resistance} = \frac{\text{Image density after water immersion}}{\text{Image density before water immersion}} \times 100$$

The recording medium was evaluated to be "good" when the water resistance was higher than 95, to be "fair" when the resistance was in the range of from 88 to 95, and to be "poor" when the resistance was lower than 88.

[Light-fastness]

Bk single color solid-printing was conducted with the same ink-jet printer and the same ink in the above ink absorbency test. The ink was used in an amount of 100%. Thereafter, the printed recording medium was left standing at room temperature. The color tone (L*) of the printed area was measured one day and 30 days after the printing, and the change ratio was derived. The recording medium was evaluated to be "good" when the change ratio was not more than ±10%, to be "fair" when it was not more than ±20%, and to be "poor" when it was more than ±20%.

[Migration]

One-dot printing of single color was conducted with the same ink-jet printer and the same ink as the ones used in the above ink absorbency test. The major diameters of the ink dots were measured one day and 30 days after the printing. The migration of the ink is prescribed by the equation below:

$$\text{Migration} = \frac{\text{Major diameter after 30 days}}{\text{Major diameter after one day}} \times 100$$

The recording medium was evaluated to be "good" in view of absence of migration of ink when the above value of migration was less than 105, to be "fair" when it was in the range of from 105 to 110, and to be "poor" when it was more than 110.

EXAMPLES 1 to 4

Aluminum dodecyloxide was prepared according to the method described in U.S. Pat. No. 4,242,271. Then the resulting aluminum dodecyloxide was hydrolyzed into alumina in a slurry state according to the method described in U.S. Pat. No. 4,202,870. To this alumina slurry, water was added to dilute it to the content of solid alumina hydrate of boehmite structure of 7.9% in the slurry. The alumina slurry showed a pH of 9.5. The pH was adjusted by adding 3.9% nitric acid solution. The slurry was aged under the conditions shown in Table 1 to obtain colloidal sols. This colloidal sols were spray-dried at 85° C. to obtain samples of powdery alumina hydrate of boehmite structure.

TABLE 1

Aging Conditions of Alumina hydrate

| | Example No. | | | |
|---|---|---|---|---|
| | 1 | 2 | 3 | 4 |
| pH before aging | 6.6 | 6.6 | 6.8 | 6.4 |
| Aging temperature (° C.) | 48 | 49 | 50 | 35 |
| Aging period (days) | 14 | 16 | 18 | 16 |
| Aging apparatus | Oven | Oven | Oven | Oven |
| Crystallinity | 20.2 | 31.0 | 45.5 | 26.1 |
| BET specific surface area ($m^2/g$) | 200 | 180 | 210 | 230 |
| Pore volume ($cm^3/g$) | 0.70 | 0.75 | 0.71 | 0.68 |

The alumina hydrate of boehmite structure was dispersed in deionized water at a concentration of 17% by weight to obtain an alumina liquid dispersion. Separately, polyvinyl alcohol (trade name: Gosenol NH18 (hereinafter referred to as "PVA"), Nippon Gosei Kagaku K.K.) was mixed with deionized water at a concentration of 17% by weight to obtain a PVA solution. The alumina liquid dispersion and the PVA solution were mixed at a mixing ratio of 18:1 to obtain a coating liquid. This coating liquid was applied onto a resin-coated paper sheet by means of an extrusion coater at a coating temperature of 100° C. under shearing stress of 7.5 $N/m^2$ (75 $dyn/cm^2$), and was delivered without blowing of drying air for one second to thicken and set the coating layer by utilizing thixotropy. Then the coating layer was dried for 30 seconds in an environment of relative humidity of 40% at a temperature shown in Table 2. The resulting recording medium was evaluated for the printing properties, etc. The evaluation results are shown in Table 2.

TABLE 2

Evaluation results

| | Example No. | | | |
|---|---|---|---|---|
| | 1 | 2 | 3 | 4 |
| Drying temperature (° C.) | 72 | 80 | 90 | 72 |
| Crystallinity | 19.8 | 32.2 | 47.5 | 28.1 |
| BET specific surface area ($m^2/g$) | 180 | 165 | 185 | 195 |
| Pore volume ($cm^3/g$) | 0.50 | 0.58 | 0.56 | 0.51 |
| Ink Absorbency | Good | Good | Good | Good |
| Ink absorption rate (seconds) | <10 | <10 | <10 | <10 |
| Surface hardness | HB | H | H | H |
| Cracking | Fair | Good | Good | Good |

EXAMPLE 5

A recording medium (before heating) was prepared in the same manner as in Examples 1 to 4 except that the aging conditions and drying conditions of the alumina hydrate were changed as shown in Table 3, the drying temperature was 68° C., the drying time was 30 seconds and the relative humidity was 50%. The resulting recording medium was further heated for 30 minutes in an oven kept at a temperature of 80° C. and a relative humidity of 12% (recording medium after heating). The properties of the recording medium before and after heating are shown in Table 4. The heating treatment of the recording medium in this Example increases the crystallinity thereof, and thereby improving the ink absorbency, as shown in Table 4.

TABLE 3

Aging conditions of Alumina hydrate in Examples 5, and 6–11

| | Example No. | | |
|---|---|---|---|
| | 5 | 6–10 | 11 |
| pH before aging | 6.4 | 6.3 | 6.1 |
| Aging temperature (° C.) | 32 | 34 | 33 |
| Aging period (days) | 15 | 18 | 16 |
| Aging apparatus | Oven | Oven | Oven |
| Crystallinity | 10.0 | 47.2 | 12.0 |
| BET specific surface area ($m^2/g$) | 220 | 235 | 230 |
| Pore volume ($cm^3/g$) | 0.73 | 0.75 | 0.71 |

TABLE 4

Evaluation Results in Example 5

| | Before heating | After heating |
|---|---|---|
| Crystallinity | 10.0 | 19.0 |
| Parallelization degree | 2.2 | 2.2 |
| BET specific surface area ($m^2/g$) | 190 | 190 |
| Pore volume ($cm^3/g$) | 0.56 | 0.56 |
| Ink Absorbency | Fair | Good |
| Ink absorption rate (seconds) | 17 | <10 |
| Surface hardness | F | H |
| Cracking | Fair | Good |
| Circularity | 0.89 | 0.87 |
| Gloss | 52 | 53 |

EXAMPLES 6 to 10

Alumina hydrate liquid dispersions were prepared in the same manner as in Examples 1–4 except that the aging conditions and drying conditions were changed as shown in Table 3. The liquid dispersion was applied by means of an extrusion coater and dried. The shearing stress given to the coating liquid was adjusted to be 0.2 $N/m^2$ (Example 6), 6.0 $N/m^2$ (Example 7), 10.0 $N/m^2$ (Example 8), 14.0 $N/M^2$ (Example 9), and 18.0 $N/M^2$ (Example 10) respectively by changing the slit width and the extrusion pressure. The amount of the coating was 6 $g/m^2$ in each Example.

The coating was conducted at a rate of 1 m/s. The coated material was delivered without blowing of drying air for one second after the coating application to thicken and set the coating by utilizing thixotropy of the coating liquid, and then it was dried for 20 seconds at 90° C. at a relative humidity of 40%.

The resulting recording mediums were evaluated for printing properties. The results are shown in Table 5. The recording mediums prepared in these Examples changed their parallelization degree depending on the shearing stress given to the coating liquid, thereby changing the gloss.

TABLE 5

Evaluation Results in Examples 6–10

| | Example No. | | | | |
|---|---|---|---|---|---|
| | 6 | 7 | 8 | 9 | 10 |
| Shearing stress ($N/m^2$) | 0.2 | 6.0 | 10.0 | 14.0 | 18.0 |
| Parallelization degree | 2.2 | 3.3 | 3.5 | 3.1 | 2.1 |
| BET specific surface area ($m^2/g$) | 193 | 193 | 193 | 193 | 193 |
| Pore volume ($cm^3/g$) | 0.57 | 0.57 | 0.57 | 0.57 | 0.57 |
| Circularity | 0.88 | 0.92 | 0.95 | 0.93 | 0.87 |
| Gloss | 53 | 62 | 68 | 59 | 51 |

EXAMPLE 11

Alumina hydrate liquid dispersion was prepared in the same manner as in Example 1 except that the aging conditions and the drying conditions were changed as shown in Table 3. With this liquid dispersion, a recording medium was prepared in the same manner as in Example 1 except that the relative humidity was changed to 15%. The evaluation results are shown in Table 6. The alumina hydrate in the recording medium prepared in this Example had higher crystallinity, and thereby the ink absorbency was improved as shown in Table 6.

TABLE 6

Evaluation Results in Example 11

| | Example 11 |
|---|---|
| Crystallinity | 20.0 |
| BET specific surface area ($m^2/g$) | 195 |
| Pore volume ($cm^3/g$) | 0.56 |
| Ink Absorbency | Good |
| Ink absorption rate | Good |
| Surface hardness | H |
| Cracking | Good |

EXAMPLES 12 to 15

Alumina hydrate liquid dispersions were prepared in the same manner as in Examples 1–4 except that the aging conditions and drying conditions for the alumina hydrate of boehmite structure were changed as shown in Table 7. The liquid dispersions were applied and dried respectively by means of a kiss-roll coater. The shearing stresses given to the liquid dispersions are shown in Table 7. The shearing stress was adjusted by changing the slit width and the extrusion pressure of the coating head. The amount of the coating was 7 $g/m^2$ in each Example. The coating was conducted at a rate of 0.8 m/s. The coated material was delivered without blowing drying air for one second after the coating application to thicken and set the coating by utilizing thixotropy of the coating liquid, then it was dried for 25 seconds at 85° C. and at a relative humidity of 35%.

Table 8 shows the results of the evaluation of the resulting recording medium.

TABLE 7

Aging and Coating Conditions for Alumina hydrate

| | Example No. | | | |
|---|---|---|---|---|
| | 12 | 13 | 14 | 15 |
| pH before aging | 6.3 | 6.6 | 6.3 | 6.5 |
| Aging temperature (° C.) | 35 | 38 | 40 | 33 |
| Aging period (days) | 16 | 12 | 15 | 17 |
| Aging apparatus | Oven | Oven | Oven | Oven |
| Crystallinity | 16.0 | 45.2 | 52.5 | 30.0 |
| Shearing stress ($N/m^2$) | 0.2 | 10.8 | 19.8 | 0.3 |
| BET specific surface area ($m^2/g$) | 225 | 215 | 210 | 220 |
| Pore volume ($cm^3/g$) | 0.70 | 0.71 | 0.71 | 0.70 |

TABLE 8

Evaluation Results in Examples 12–15

| | Example No. | | | |
|---|---|---|---|---|
| | 12 | 13 | 14 | 15 |
| Crystallinity | 16.5 | 45.3 | 52.6 | 28.6 |
| Parallelization degree | 1.6 | 1.8 | 2.6 | 1.7 |
| BET specific surface Area ($m^2/g$) | 190 | 187 | 185 | 188 |
| Pore volume ($cm^3/g$) | 0.51 | 0.52 | 0.52 | 0.51 |
| Light fastness | Good | Good | Good | Fair |
| Water fastness | Fair | Good | Good | Good |
| Ink migration | Good | Good | Good | Good |

The present invention has the advantages listed below:

(1) A recording medium having higher ink absorbency, absorbing ink at a higher rate, and having a higher surface hardness is obtained by adjusting the crystallinity of alumina hydrate in the recording medium to be within in the specified range.

(2) A recording medium enabling higher circularity of printed dots and having higher gloss is obtained by adjusting the parellelization degree of alumina hydrate in the recording medium to be within the specified range.

(3) A printed matter having better light fastness and water resistance and being less likely to cause migration of ink is obtained by adjusting the crystallinity and the parallelization degree respectively to be within the specified ranges.

What is claimed is:

1. A recording medium having a porous ink-receiving layer containing alumina hydrate of boehmite structure formed on a base material, said ink-receiving layer formed of a dried coating of a liquid dispersion of said alumina hydrate onto said base material, an amount of said dried coating ranging from 2 to 60 $g/m^3$, and said ink-receiving layer having a total pore volume ranging from 0.1 to 1.0 $cm^3/g$, wherein microcrystals of said alumina hydrate are directed to be parallel to a plane direction of said ink-receiving layer at a parallelization degree of not less than 1.5, wherein the maximum length or the maximum diameter of said microcrystals ranges from 1 to 50 nm, and the parallelization degree is defined by an equation:

$$\text{Parallelization degree} = \frac{\text{Intensity ratio for medium}}{\text{Intensity ratio for powder}}$$

wherein $$\text{Intensity ratio for medium} = \frac{\text{Peak intensity for plane (020) of medium}}{\text{Peak intensity for plane (120) of medium}},$$

and $$\text{Intensity ratio for powder} = \frac{\text{Peak intensity for plane (020) of powder}}{\text{Peak intensity for plane (120) of powder}};$$

wherein said peak intensities are measured for each of the planes of medium and powder from X-ray diffraction measurements of the ink-receiving layer of the recording medium, and a powder obtained by pulverizing the ink-receiving layer, respectively.

2. The recording medium according to one of claim 1, wherein said parallelization degree is not less than 2.

3. A recording medium having a porous ink-receiving layer containing alumina hydrate of boehmite structure formed on a base material, said ink-receiving layer formed of a dried coating of a liquid dispersion of said alumina hydrate onto said base material, an amount of said dried coating ranging from 2 to 60 $g/m^3$, and said ink-receiving layer having a total pore volume ranging from 0.1 to 1.0 $cm^3/g$, the crystallinity of said alumina hydrate in said porous ink-receiving surface layer ranging from 15 to 80, and microcrystals of the alumina hydrate being directed to be parallel to a plane direction of said ink-receiving layer at a parallelization degree of not less than 1.5, wherein the maximum length or the maximum diameter of said microcrystals ranges from 1 to 50 nm, and the parallelization degree is defined by an equation:

$$\text{Parallelization degree} = \frac{\text{Intensity ratio for medium}}{\text{Intensity ratio for powder}}$$

wherein $$\text{Intensity ratio for medium} = \frac{\text{Peak intensity for plane (020) of medium}}{\text{Peak intensity for plane (120) of medium}},$$

and $$\text{Intensity ratio for powder} = \frac{\text{Peak intensity for plane (020) of powder}}{\text{Peak intensity for plane (120) of powder}};$$

wherein said peak intensities are measured for each of the planes of medium and powder from X-ray diffraction measurements of the ink-receiving layer of the recording medium, and a powder obtained by pulverizing the ink-receiving layer, respectively.

4. The recording medium according to one of claim 3, wherein the crystallinity of said alumina hydrate in said porous ink-receiving surface layer ranges from 20 to 70.

5. The recording medium according to one of claim 3, wherein said parallelization degree is not less than 2.

6. A recording medium for ink-jet recording having a porous ink-receiving layer containing alumina hydrate of boehmite structure formed on a base material, said ink-receiving layer formed of a dried coating of a liquid dispersion of said alumina hydrate onto said base material, an amount of said dried coating ranging from 2 to 60 $g/m^3$, and said ink-receiving layer having a total pore volume ranging from 0.1 to 1.0 $cm^3/g$, wherein microcrystals of said alumina hydrate are directed to be parallel to a plane direction of said ink-receiving layer at a parallelization degree of not less than 1.5, wherein the maximum length or the maximum diameter of said microcrystals ranges from 1 to 50 nm.

7. A recording medium for ink-jet recording having a porous ink-receiving layer containing alumina hydrate of boehmite structure formed on a base material, said ink-receiving layer formed of a dried coating of a liquid dispersion of said alumina hydrate onto said base material, an amount of said dried coating ranging from 2 to 60 $g/m^3$, and said ink-receiving layer having a total pore volume ranging from 0.1 to 1.0 $cm^3/g$, said alumina hydrate having crystallinity ranging from 15 to 80, and microcrystals of the alumina hydrate being directed to be parallel to a plane direction of said ink-receiving layer at a parallelization degree of not less than 1.5, wherein the maximum length or the maximum diameter of said microcrystals ranges from 1 to 50 nm.

* * * * *

UNITED STATES PATENT AND TRADEMARK OFFICE

CERTIFICATE OF CORRECTION

PATENT NO. : 6,342,289 B1 
DATED : January 29, 2002
INVENTOR(S) : Eguchi et al.

It is certified that error appears in the above-identified patent and that said Letters Patent is hereby corrected as shown below:

Column 1,
Line 16, "Ink jet" should read -- Ink-jet --;
Line 18, "a" (second occurrence) should be deleted, and "Ink jet" should read -- Ink-jet --;
Line 44, "cracking" should be deleted; and
Line 64, "A still" should read -- Still --.

Column 3,
Line 18, "an" should read -- one --;
Line 36, "$Al_2O_{3-n}(OH)_2.mH_2O$" should read -- $Al_2O_{3-n}(OH)_{2n}.mH_2O$ --; and
Line 39, "case" should read -- cases --.

Column 4,
Line 19, "-The" should read -- The -- and should begin a new paragraph.

Column 5,
Line 42, "almina" should read -- alumina --; and
Line 58, "the idea" should read -- an idea --.

Column 9,
Line 20, "serves" should read -- serve --.

Column 13,
Table 3, Title, "conditions" should read -- Conditions --, and "hydrate" should read -- Hydrate --.

Column 16,
Line 20, "claim 1" should read -- claim 1 or 6 --; and
Lines 56 and 59, "claim 3" should read -- claim 3 or 7 --.

Signed and Sealed this

Twenty-seventh Day of May, 2003

JAMES E. ROGAN
*Director of the United States Patent and Trademark Office*